US010578103B2

(12) United States Patent
Koyama et al.

(10) Patent No.: US 10,578,103 B2
(45) Date of Patent: Mar. 3, 2020

(54) SCROLL COMPRESSOR AND REFRIGERATION CYCLE APPARATUS

(71) Applicant: Mitsubishi Electric Corporation, Tokyo (JP)

(72) Inventors: Shuhei Koyama, Tokyo (JP); Masahiro Nakatani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 182 days.

(21) Appl. No.: 15/569,837

(22) PCT Filed: Jun. 11, 2015

(86) PCT No.: PCT/JP2015/066929

§ 371 (c)(1),
(2) Date: Oct. 27, 2017

(87) PCT Pub. No.: WO2016/199281

PCT Pub. Date: Dec. 15, 2016

(65) Prior Publication Data

US 2018/0128270 A1 May 10, 2018

(51) Int. Cl.
*F03C 2/00* (2006.01)
*F03C 4/00* (2006.01)
(Continued)

(52) U.S. Cl.
CPC ..... *F04C 18/07* (2013.01); *F04C 18/0215* (2013.01); *F04C 18/0238* (2013.01);
(Continued)

(58) Field of Classification Search
CPC ..... F04C 18/0215; F04C 18/0238; F04C 18/0253; F04C 18/0261; F04C 18/0284;
(Continued)

(56) References Cited

U.S. PATENT DOCUMENTS 4,673,340 A * 6/1987 Mabe ..... F04C 29/0007 418/15
5,722,257 A * 3/1998 Ishii ..... F04C 18/0261 418/55.5
(Continued)

FOREIGN PATENT DOCUMENTS

JP H05-296165 A 11/1993
JP 2002-013491 A 1/2002
JP 2012-127222 A 7/2012

OTHER PUBLICATIONS

Extended EP Search Report dated Feb. 11, 2019 issued in corresponding EP patent application No. 15894966.9.
(Continued)

*Primary Examiner* — Theresa Trieu
(74) *Attorney, Agent, or Firm* — Posz Law Group, PLC

(57) ABSTRACT

A scroll compressor includes a shell, a fixed scroll and an orbiting scroll disposed in the shell, a first scroll wrap and a second scroll wrap that are provided in the fixed scroll and the orbiting scroll, respectively, and that are engaged with each other to form a plurality of compression chambers, a crankshaft that causes the orbiting scroll to perform eccentric revolving motion, a tip seal member that is inserted in the tip of the second scroll wrap along the spiral direction and that is in sliding contact with the first baseplate of the fixed scroll, and injection ports that are provided through the first baseplate of the fixed scroll and that introduce refrigerant at an intermediate pressure between suction pressure and discharge pressure into the compression chambers from the outside of the shell.

8 Claims, 7 Drawing Sheets

(51) Int. Cl.

| | |
|---|---|
| ***F04C 18/00*** | (2006.01) |
| ***F04C 18/07*** | (2006.01) |
| ***F04C 18/02*** | (2006.01) |
| ***F04C 29/00*** | (2006.01) |
| ***F25B 31/00*** | (2006.01) |
| ***F04C 27/00*** | (2006.01) |
| ***F25B 41/04*** | (2006.01) |
| ***F25B 1/10*** | (2006.01) |
| ***F04C 29/04*** | (2006.01) |
| ***F25B 1/04*** | (2006.01) |
| *F04C 29/12* | (2006.01) |
| *F25B 9/00* | (2006.01) |

(52) U.S. Cl.
CPC ..... *F04C 18/0261* (2013.01); *F04C 18/0284* (2013.01); *F04C 18/0292* (2013.01); *F04C 27/005* (2013.01); *F04C 29/0007* (2013.01); *F04C 29/042* (2013.01); *F25B 1/04* (2013.01); *F25B 1/10* (2013.01); *F25B 31/008* (2013.01); *F25B 41/04* (2013.01); *F04C 18/0253* (2013.01); *F04C 29/124* (2013.01); *F25B 9/008* (2013.01); *F25B 2400/13* (2013.01); *F25B 2600/2509* (2013.01)

(58) Field of Classification Search
CPC .... F04C 18/0292; F04C 18/07; F04C 23/008; F04C 27/005; F04C 29/0007; F04C 29/042; F04C 29/124; F25B 1/04; F25B 1/10; F25B 9/008; F25B 31/008; F25B 41/04; F25B 2400/13; F25B 2600/2509
USPC ..... 418/55.1–55.6, 57, 142, 150, 181
See application file for complete search history.

(56) References Cited

U.S. PATENT DOCUMENTS

2005/0147514 A1 7/2005 Lifson et al.
2010/0129240 A1* 5/2010 Shiibayashi ..... F04C 18/0215 418/55.2

OTHER PUBLICATIONS

International Search Report of the International Searching Authority dated Aug. 18, 2015 for the corresponding international application No. PCT/JP2015/066929 (and English translation).
Office Action dated May 31, 2019 issued in corresponding CN patent application No. 201580080684.3 (and English translation).

* cited by examiner

SCROLL COMPRESSOR AND REFRIGERATION CYCLE APPARATUS

CROSS REFERENCE TO RELATED APPLICATION

This application is a U.S. national stage application of International Application No. PCT/JP2015/066929, filed on Jun. 11, 2015, the contents of which are incorporated herein by reference.

TECHNICAL FIELD

The present invention relates to a scroll compressor and a refrigeration cycle apparatus that are mounted mainly in refrigerators, air-conditioners, and water heaters.

BACKGROUND

Hitherto, a scroll compressor has been known in which a fixed scroll and an orbiting scroll each having a scroll wrap are engaged with each other so as to form compression chambers in cooperation with each other (see, for example, Patent Literature 1). In this scroll compressor, injection ports are formed in a baseplate of the fixed scroll. By causing liquid refrigerant to flow through the injection ports into compression chambers at an intermediate pressure, the gas temperature in the compression chambers is lowered, the temperature of refrigerant discharged from the compression chambers (hereinafter referred to as discharge temperature) is reduced, and efficiency is increased.

PATENT LITERATURE

Patent Literature 1: Japanese Unexamined Patent Application Publication No. 2012-127222

In recent years, from the viewpoint of preventing global warming, the transition from conventional HFC refrigerant to refrigerant with low GWP has been progressing. For example, carbon dioxide is a candidate refrigerant that has a GWP lower than that of HFC refrigerant. Carbon dioxide is, owing to its physical property, a refrigerant that tends to have high operating pressure and high discharge temperature.

In a scroll compressor, as sealing portions that seal the axial gap between adjacent compression chambers, tip seal members are disposed on the tip surfaces of scroll wraps of a fixed scroll and an orbiting scroll. When carbon dioxide is used as refrigerant in a scroll compressor in which tip seal members are disposed on the tips surfaces of scroll wraps, the following problem arises. That is, since the use of carbon dioxide increases the pressure in the compression chambers as described above, the pressure difference between the pressure in the injection ports when injection is stopped and the pressure in the compression chambers is large. There is a problem in that when, during the eccentric revolving motion of the orbiting scroll, the tip seal member on the orbiting scroll passes over the injection ports, the tip seal member enters the injection ports owing to this pressure difference, and the tip seal member breaks.

SUMMARY

The present invention has been made to overcome the above problem, and provides a scroll compressor and a refrigeration cycle apparatus in which the breakage of a tip seal member can be prevented and the reliability can be improved.

A scroll compressor according to an embodiment of the present invention includes a shell, a fixed scroll and an orbiting scroll disposed in the shell, scroll wraps that are provided in the fixed scroll and the orbiting scroll and that are engaged with each other to form a plurality of compression chambers, a crankshaft that causes the orbiting scroll to perform eccentric revolving motion, a tip seal member that is inserted in the tip of the scroll wrap of the orbiting scroll along the spiral direction and that is in sliding contact with the baseplate of the fixed scroll, and injection ports that are provided through the baseplate of the fixed scroll and that introduce refrigerant at an intermediate pressure between suction pressure and discharge pressure into the compression chambers from the outside. The refrigerant is composed only of carbon dioxide or is a mixed refrigerant containing carbon dioxide. The diameter $\phi inj$ of the injection ports and the width TIP of the tip seal member in a direction perpendicular to the spiral direction have the relationship of $\phi inj \leq 0.95 \times TIP$.

A refrigeration cycle apparatus according to an embodiment of the present invention includes a main circuit that has a scroll compressor, a radiator, a decompression device, and an evaporator and that is configured such that these are connected in order with pipes and refrigerant circulates therethrough, an intermediate injection circuit that branches from between the radiator and the decompression device and that is connected to the injection ports of the scroll compressor, and a flow control valve that adjusts the flow rate of the intermediate injection circuit. Refrigerant in a liquid state is guided from the intermediate injection circuit to the injection ports.

According to an embodiment of the present invention, since the diameter $\phi inj$ of the injection ports and the width TIP of the tip seal member have the relationship of $\phi inj \leq 0.95 \times TIP$, a scroll compressor and a refrigeration cycle apparatus can be obtained in which the breakage of a tip seal member can be prevented and the reliability can be improved.

DETAILED DESCRIPTION

Embodiment 1

Embodiment 1 will be described below with reference to the drawings. In the following drawings, elements denoted by the same reference signs are same or equivalent, and this commonly applies through the embodiments. The forms of components described in the entire description are merely illustrative and no restrictive. For the expressions of high, low, and the like in temperature, pressure, and the like, being high, low, or the like is not determined on the basis of a relationship with any absolute value, but is relatively determined in a state, action, or the like in a system, apparatus, or the like.

Figure 1:
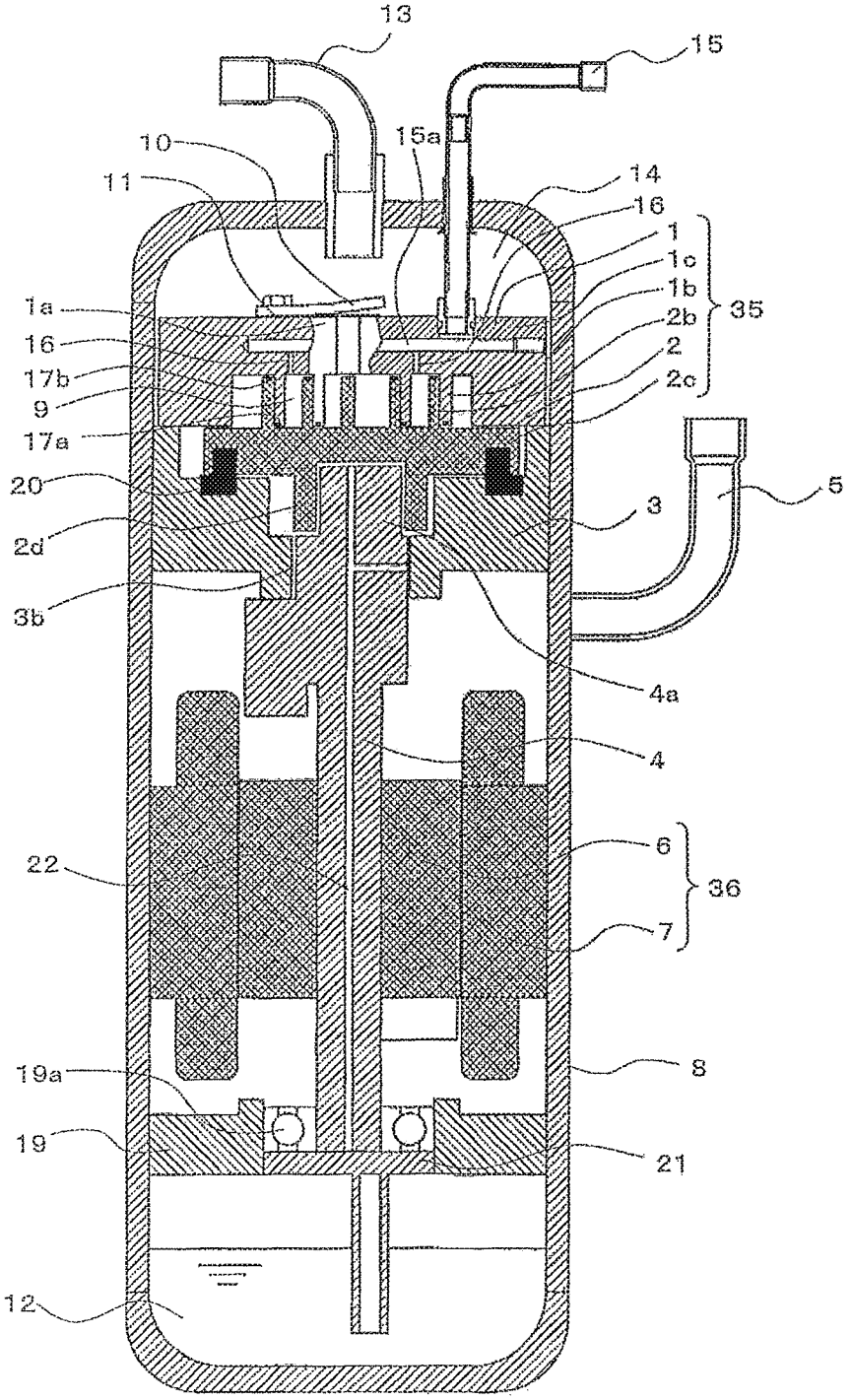
FIG. 1 is a schematic sectional view of a scroll compressor according to Embodiment 1 of the present invention.
Figure 2:
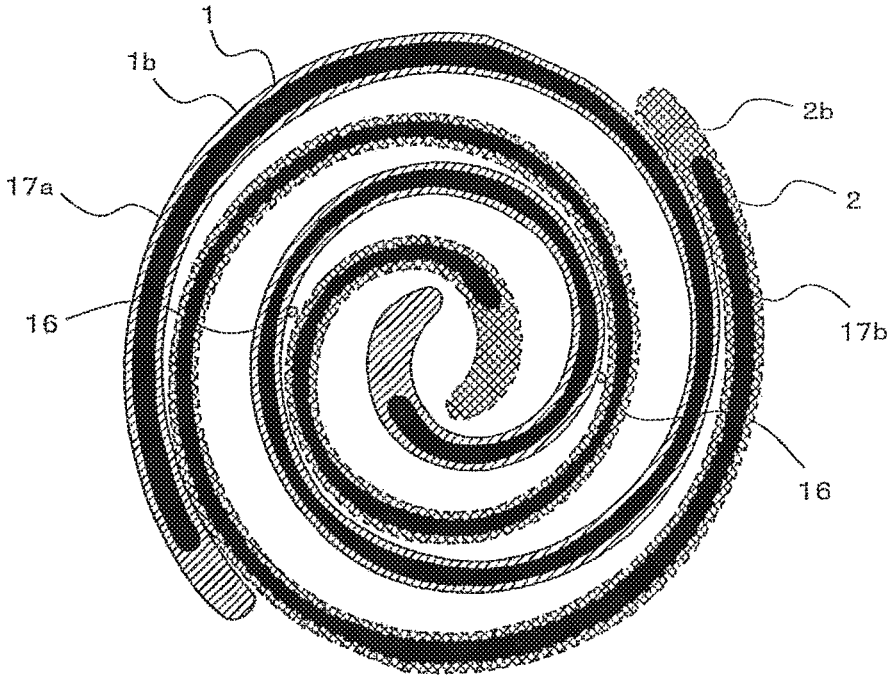
FIG. 2 is a plan view of engagement structure of a fixed scroll and an orbiting scroll according to Embodiment 1 of the present invention as seen from the orbiting scroll side in the axial direction.

FIG. 1 is a schematic sectional view of a scroll compressor according to Embodiment 1 of the present invention. FIG. 1 shows a case of a hermetic scroll compressor of the so-called high-pressure shell type as an example. FIG. 2 is a plan view of engagement structure of a fixed scroll and an orbiting scroll according to Embodiment 1 of the present invention as seen from the orbiting scroll side in the axial direction. In FIG. 2, the fixed scroll 1 is shown by solid line, and the orbiting scroll 2 is shown by dotted line.

This scroll compressor 100 has a function of suctioning refrigerant and compressing the refrigerant into a high temperature and high pressure refrigerant to be discharged. The scroll compressor 100 is configured to house a compression mechanism unit 35, a drive mechanism unit 36, and other components in a shell 8 that is a hermetic container forming an enclosure. As shown in FIG. 1, in the shell 8, the compression mechanism unit 35 is disposed in an upper part, and the drive mechanism unit 36 is disposed in a lower part. A lower part of the shell 8 serves as an oil reservoir 12.

Inside the shell 8, a frame 3 and a sub-frame 19 are disposed so as to face each other with the drive mechanism unit 36 therebetween. The frame 3 is disposed above the drive mechanism unit 36 and is located between the drive mechanism unit 36 and the compression mechanism unit 35, and the sub-frame 19 is located below the drive mechanism unit 36. The frame 3 and the sub-frame 19 are fixed to the inner peripheral surface of the shell 8 by shrink fit, welding, or the like. A bearing portion 3*b* is provided in the center of the frame 3, and a sub-bearing 19*a* is provided in the center of the sub-frame 19. A crankshaft 4 is rotatably supported by the bearing portion 3*b* and the sub-bearing 19*a*.

A suction pipe 5 for suctioning refrigerant, a discharge pipe 13 for discharging refrigerant, and an injection pipe 15 for injecting refrigerant into compression chambers 9 are connected to the shell 8.

The compression mechanism unit 35 has a function of compressing refrigerant suctioned through the suction pipe 5 and discharging it to a high-pressure space 14 formed in an upper part of the shell 8. This high-pressure refrigerant is discharged through the discharge pipe 13 to the outside of the scroll compressor 100. The drive mechanism unit 36 serves a function of driving an orbiting scroll 2 that makes up the compression mechanism unit 35 to compress refrigerant in the compression mechanism unit 35. That is, the drive mechanism unit 36 drives the orbiting scroll 2 through the crankshaft 4, and refrigerant is thereby compressed in the compression mechanism unit 35.

The compression mechanism unit 35 has a fixed scroll 1 and an orbiting scroll 2. As shown in FIG. 1, the orbiting scroll 2 is disposed on the lower side, and the fixed scroll 1 is disposed on the upper side. The fixed scroll 1 comprises a first baseplate 1*c* and a first scroll wrap 1*b* that is a spiral protrusion erected on one side of the first baseplate 1*c*. The orbiting scroll 2 consists of a second baseplate 2*c* and a second scroll wrap 2*b* that is a spiral protrusion erected on one side of the second baseplate 2*c*. The fixed scroll 1 and the orbiting scroll 2 are mounted in the shell 8 with the first scroll wrap 1*b* and the second scroll wrap 2*b* engaged with each other. The first scroll wrap 1*b* and the second scroll wrap 2*b* are formed along an involute curve, the first scroll wrap 1*b* and the second scroll wrap 2*b* are engaged with each other, and a plurality of compression chambers 9 are thereby formed between the first scroll wrap 1*b* and the second scroll wrap 2*b*.

The fixed scroll 1 is fixed in the shell 8 via the frame 3. A discharge port 1*a* that discharges refrigerant compressed to a high pressure is formed in the center of the fixed scroll 1. At the outlet opening of the discharge port 1*a*, a valve 11 formed of a blade spring is disposed to cover the outlet opening and prevent backflow of refrigerant. At one end of the valve 11, a valve guard 10 is provided that limits the amount of lift of the valve 11. That is, when refrigerant is compressed to a predetermined pressure in the compression chambers 9, the valve 11 is lifted up against its elastic force. The compressed refrigerant is discharged through the discharge port 1*a* into the high-pressure space 14, and is discharged through the discharge pipe 13 to the outside of the scroll compressor 100.

In the first baseplate 1*c* of the fixed scroll 1, injection ports 16 are formed at positions not communicating with a low-pressure space (suction pressure space). The injection ports 16 are ports for injecting liquid refrigerant at an intermediate pressure (pressure between suction pressure and discharge pressure) from the outside of the shell 8 into the compression chambers 9 in which refrigerant in the process of being compressed exists. The injection ports 16 are provided one for each of a pair of compression chambers 9 symmetrical with respect to a center of the first scroll wrap 1*b* and the second scroll wrap 2*b*, and are configured such that the pressures in the pair of symmetrical compression chambers 9 are equal to each other.

In the fixed scroll 1, an injection distribution channel 15*a* is formed that divides injection refrigerant supplied from the injection pipe 15 into two and causes them to flow into the two injection ports 16. Although, in FIG. 1, an example is shown in which the injection distribution channel 15*a* is composed of a hole formed in the fixed scroll 1, the injection distribution channel 15*a* may be formed of a pipe independent from the fixed scroll 1. That is, the injection distribution channel 15*a* may have various configurations as long as it has a pipe that guides injection refrigerant from the outside of the shell 8 to the injection ports 16 located in the shell 8, and the outflow side of the pipe branch in two directions and communicate with the injection ports 16.

The orbiting scroll 2 performs an eccentric revolving motion relative to the fixed scroll 1 without rotating. A hollow cylindrical recessed bearing 2*d* that receives driving force is formed substantially in the center of a surface (hereinafter referred to as thrust surface) of the orbiting scroll 2 that is opposite to the surface on which the second scroll wrap 2*b* is formed. A later-described eccentric pin portion 4*a* provided at the upper end of the crankshaft 4 is fitted in (engaged with) the recessed bearing 2*d*.

A tip seal member 17*a* and a tip seal member 17*b* are inserted in the tips of the first scroll wrap 1*b* and the second scroll wrap 2*b* of the fixed scroll 1 and the orbiting scroll 2 along the spiral direction as shown by the blackened parts in FIG. 2. The tip seal member 17*a* and the tip seal member 17*b* are movable in the axial direction (the vertical direction in FIG. 1 and FIG. 5) in a groove portion 18*a* (see FIG. 5 to be described later) and a groove portion 18*b* that accommodate these. The orbiting scroll 2 performs an eccentric revolving motion relative to the fixed scroll 1, thereby the tip seal member 17*a* comes into sliding contact with the surface (wrap bottom surface) of the second baseplate 2*c* of the orbiting scroll 2, the tip seal member 17*b* comes into sliding contact with the surface (wrap bottom surface) of the first baseplate 1*c* of the fixed scroll 1, and the axial gap between adjacent compression chambers 9 is thereby sealed.

The drive mechanism unit 36 at least includes a stator 7, a rotor 6 that is rotatably disposed on the inner peripheral surface side of the stator 7 and that is fixed to the crankshaft 4, and the crankshaft 4 that is housed vertically in the shell 8 and that is a rotating shaft. The stator 7 is configured to rotationally drive the rotor 6 by being energized. The outer peripheral surface of the stator 7 is fixed to and supported by the shell 8 by shrink fit or the like. The rotor 6 is configured to be rotationally driven when the stator 7 is energized, and rotating the crankshaft 4. The rotor 6 is fixed to the outer peripheral surface of the crankshaft 4, has a permanent magnet therein, and is held with a slight gap between the rotor 6 and the stator 7.

The crankshaft 4 has an eccentric pin portion 4*a* formed at the upper end thereof. The eccentric pin portion 4*a* is fitted in the recessed bearing 2*d* of the orbiting scroll 2. The orbiting scroll 2 is caused to perform an eccentric revolving motion by the rotation of the crankshaft 4.

An oil pump 21 is fixed to the lower side of the crankshaft 4. The oil pump 21 is a positive-displacement pump, and has a function of supplying refrigerating machine oil stored in the oil reservoir 12 to the recessed bearing 2*d* and the bearing portion 3*b* through an oil circuit 22 provided in the crankshaft 4 with the rotation of the crankshaft 4.

In the shell 8, an Oldham ring 20 for preventing the rotation of the orbiting scroll 2 during the eccentric revolving motion thereof is disposed. The Oldham ring 20 is disposed between the fixed scroll 1 and the orbiting scroll 2, and serves a function of preventing the rotation of the orbiting scroll 2 while allowing for revolution.

The operation of the scroll compressor 100 will be described briefly.

When a not shown supply terminal provided in the shell 8 is energized, torque is generated in the stator 7 and the rotor 6, and the crankshaft 4 rotates. By the rotation of the crankshaft 4, the orbiting scroll 2 is caused to perform eccentric revolving motion while being prevented from rotating by the Oldham ring 20. Refrigerant suctioned through the suction pipe 5 into the shell 8 is introduced into outer peripheral ones 9 of the plurality of compression chambers 9 formed between the first scroll wrap 1*b* of the fixed scroll 1 and the second scroll wrap 2*b* of the orbiting scroll 2.

The compression chambers 9 into which gas is introduced decrease their volumes while moving from the outer periphery toward the center with the eccentric revolving motion of the orbiting scroll 2, thereby compressing refrigerant. The compressed refrigerant gas is discharged through the discharge port 1*a* provided to the fixed scroll 1 against the valve guard 10, and is discharged through the discharge pipe 13 to the outside of the shell 8.

Figure 3:
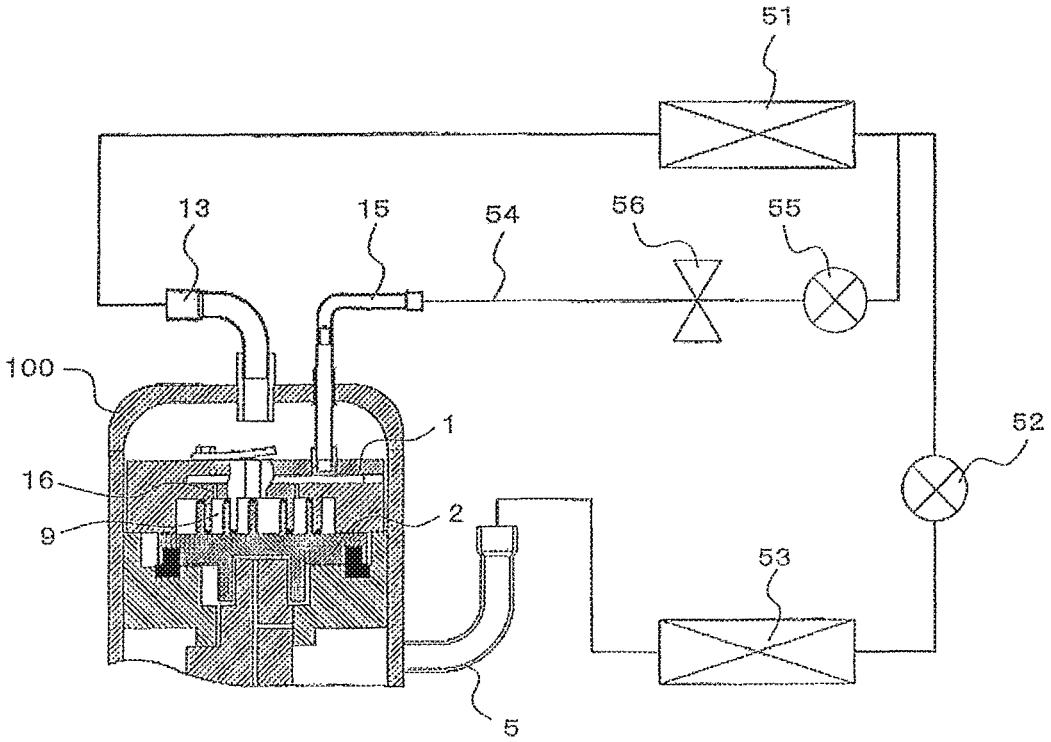
FIG. 3 is a circuit configuration diagram showing a refrigerant circuit of a refrigeration cycle apparatus having the scroll compressor according to Embodiment 1 of the present invention.

FIG. 3 is a circuit configuration diagram showing a refrigerant circuit of a refrigeration cycle apparatus having the scroll compressor according to Embodiment 1 of the present invention.

The refrigeration cycle apparatus of FIG. 3 has a main circuit that has a scroll compressor 100, a radiator 51, an expansion valve 52 serving as a decompression device, and an evaporator 53 and that is configured such that these elements are connected in order with pipes and refrigerant circulates therethrough. The refrigeration cycle apparatus further has an intermediate injection circuit 54 that branches from between the radiator 51 and the expansion valve 52 and that is connected to the injection pipe 15 of the scroll compressor 100. The intermediate injection circuit 54 is provided with an expansion valve 55 serving as a flow control valve, and a solenoid valve 56 serving as an on-off valve that opens and closes the intermediate injection circuit 54. The expansion valve 55 and the solenoid valve 56 are controlled by a controller not shown, and the flow rate injected into the compression chambers 9 can be adjusted by controlling the expansion valve 55. Carbon dioxide ($CO_2$) is charged as refrigerant in the refrigeration cycle apparatus. A mixed refrigerant containing carbon dioxide may also be used as refrigerant.

Next, the operation of the refrigeration cycle apparatus will be described.

Refrigerant discharged from the scroll compressor 100 flows into the radiator 51, exchanges heat with air passing through the radiator 51 to radiate heat, and flows out of the radiator 51. The expansion coefficient by throttling and flow rate of refrigerant flowing out of the radiator 51 are controlled by the expansion valve 52, and then refrigerant flows into the evaporator 53. Low-pressure two-phase refrigerant flowing into the evaporator 53 exchanges heat with air passing through the evaporator 53, then returns to the inside of the scroll compressor 100 through the suction pipe 5, and is suctioned into the compression chambers 9 again.

Here, for example, in operation in which the difference between the temperature of refrigerant suctioned into the scroll compressor 100 (hereinafter referred to as suction temperature) and the discharge temperature is large, that is, operation in which the difference between high pressure and low pressure is large (hereinafter referred to as high compression ratio operation), refrigerant discharged through the discharge pipe 13 is at a high temperature. So, by injecting liquid refrigerant taken out from the refrigerant outlet of the radiator 51 into the compression chambers 9, the discharge temperature is lowered. Specifically, after high-pressure liquid refrigerant is taken out from the radiator 51, the expansion coefficient by throttling and flow rate are controlled by the expansion valve 52 and the solenoid valve 56, and the refrigerant is decompressed to the intermediate pressure. Liquid refrigerant at the intermediate pressure enters the inside of the scroll compressor 100 through the injection pipe 15. Liquid refrigerant entering the inside of the scroll compressor 100 passes through the injection distribution channel 15*a* formed in the fixed scroll 1 and the injection ports 16, is injected into the compression chambers 9, and cools gas refrigerant being compressed in the compression chambers 9. Injecting liquid refrigerant at the intermediate pressure may hereinafter be referred to as intermediate injection.

Figure 4:
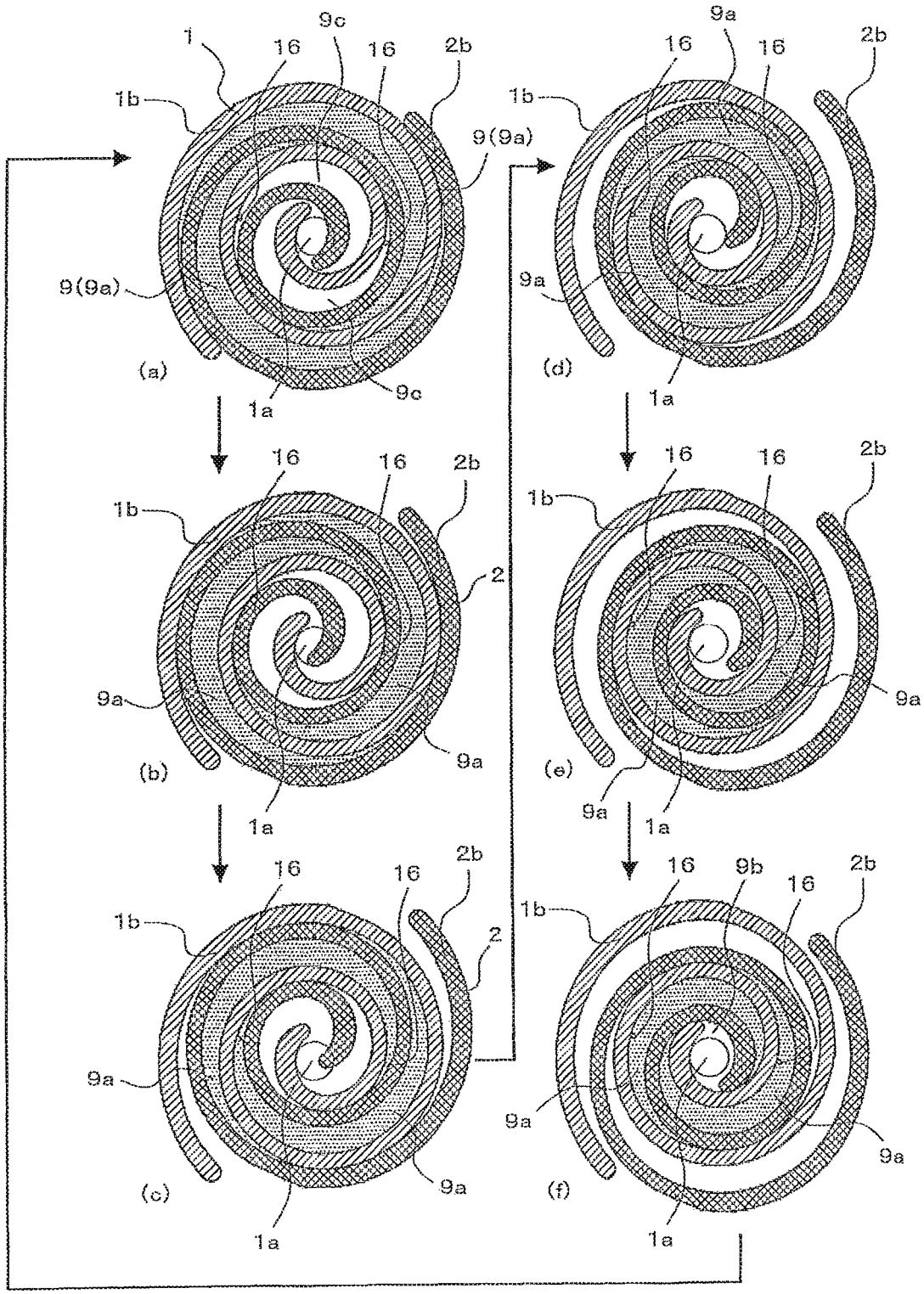
FIG. 4 is a compression process diagram of the scroll compressor of FIG. 1.

FIG. 4 is a compression process diagram of the scroll compressor of FIG. 1, on which the compression process of the compression chambers is shown for every 60 degrees. The operation of the compression mechanism unit 35 of the scroll compressor 100 will be described briefly with reference to FIG. 4 and FIG. 1.

FIG. 4 (*a*) shows a state where the suction into the compression chambers 9 formed by the fixed scroll 1 and the orbiting scroll 2 is completed, and a pair of outermost chambers (dotted parts in FIG. 4) are formed (refrigerant confinement completion angle; 0 degrees). Here, the operation of the compression mechanism unit 35 will be described with a focus on compression chambers 9*a* that are outermost chambers in FIG. 4 (*a*).

In FIG. 4 (*b*), the revolving motion of the orbiting scroll 2 progresses, and the first scroll wrap 1*b* and the second scroll wrap 2*b* move over the injection ports 16.

In FIG. 4 (*c*), the revolving motion of the orbiting scroll 2 further progresses, and the injection ports 16 communicate with the compression chambers 9*a*. Intermediate injection is thereby performed through the injection ports 16 into the compression chambers 9*a*, and the insides of the compression chambers 9*a* are cooled.

In FIG. 4 (*d*), the revolving motion of the orbiting scroll 2 further progresses, the compression chambers 9*a* and the injection ports 16 continue to communicate with each other, and cooling of the insides of the compression chambers 9*a* by intermediate injection is performed.

In FIG. 4 (*e*), the revolving motion of the orbiting scroll 2 further progresses, the compression chambers 9*a* and the injection ports 16 continue to communicate with each other, and cooling of the insides of the compression chambers 9*a* by intermediate injection is performed.

In FIG. 4 (*f*), the revolving motion of the orbiting scroll 2 further progresses, the compression chambers 9*a* and the injection ports 16 continue to communicate with each other, and cooling of the insides of the compression chambers 9*a* by intermediate injection is performed. In FIG. 4 (*f*), the compression chambers 9*a* communicate with the innermost chamber 9*b* on the inner side thereof that communicates with the discharge port 1*a*. Therefore, the injection ports 16 opening into the compression chambers 9*a* communicate with the discharge port 1*a*. Therefore, in FIG. 4 (*f*), the injection ports 16 communicate with the discharge port 1*a*, and intermediate injection is continuously performed.

The revolving motion of the orbiting scroll 2 further progresses, and then the scroll wraps return to the state of FIG. 4 (*a*). At this time, intermediate injection is continuously performed in the compression chambers 9*c* on the inner side of the outermost chambers.

In high compression ratio operation, since injection is performed, liquid refrigerant passes through the injection ports 16. However, in operation other than high compression ratio operation, since injection is stopped, liquid refrigerant does not pass through the injection ports 16, and the injection ports 16 are empty. In the present invention, carbon dioxide is used as refrigerant, and operating pressure is as high as three to four times compared to HFC refrigerant. Therefore, the pressure difference between the pressure in the injection ports 16 and the pressure in the compression chambers 9 is large. To prevent the breakage of the tip seal member 17*b* due to the deformation of the tip seal member 17*b* caused by such pressure difference, the following measures are taken.

Figure 5:
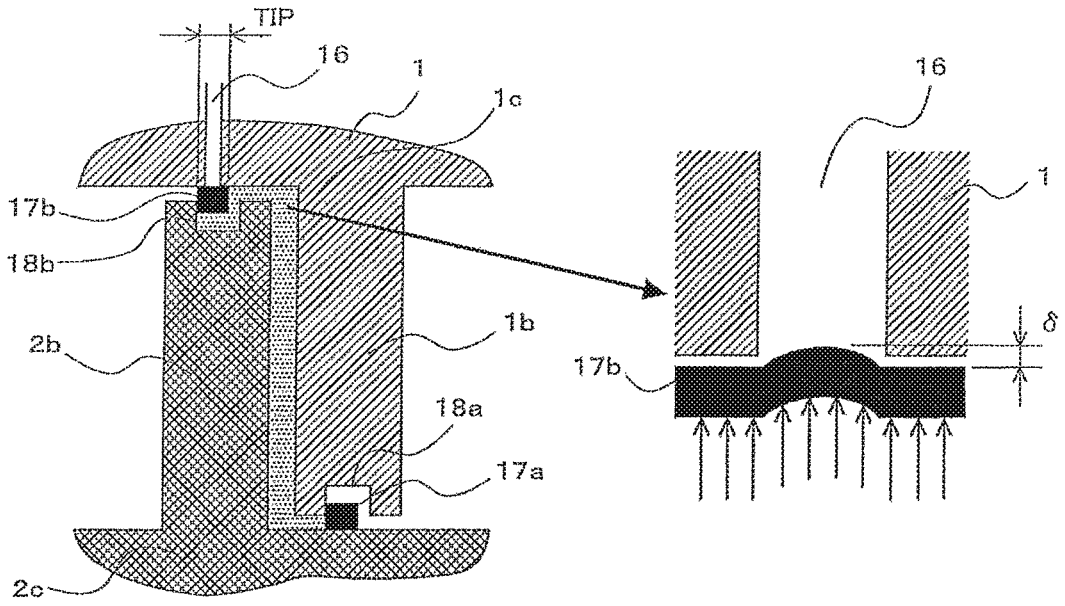
FIG. 5 is a sectional view of a compression chamber when intermediate injection is not performed in the scroll compressor according to Embodiment 1 of the present invention.
Figure 6:
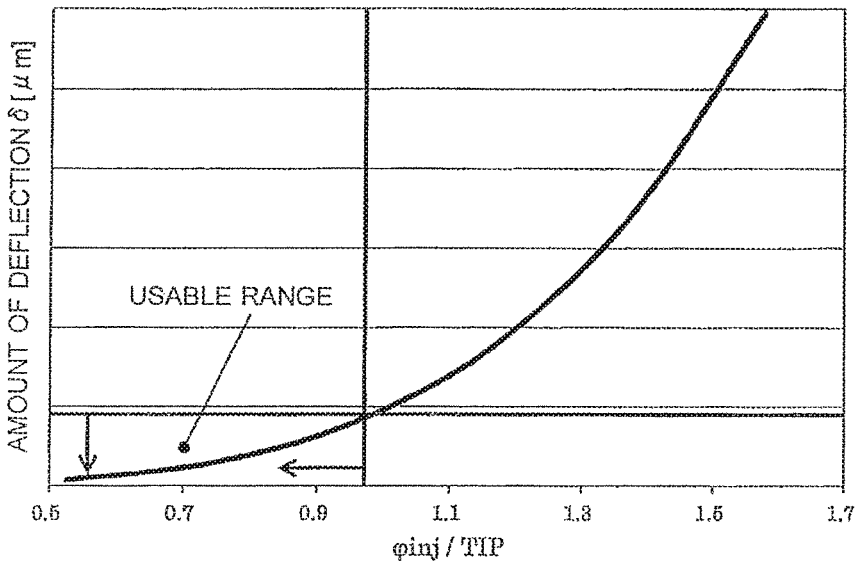
FIG. 6 is a graph showing the results of an actual machine test for examining, in the scroll compressor according to Embodiment 1 of the present invention, the relationship between the ratio of injection port diameter $\phi inj$ to tip seal width TIP and the amount of deflection $\delta$ [μm] due to pressure difference of the tip seal member 17*b* on the orbiting scroll 2 side.

FIG. 5 is a sectional view of a compression chamber when intermediate injection is not performed in the scroll compressor according to Embodiment 1 of the present invention. FIG. 6 is a graph showing the results of an actual machine test for examining, in the scroll compressor according to Embodiment 1 of the present invention, the relationship between the ratio of injection port diameter $\phi$inj to tip seal width TIP and the amount of deflection $\delta$ [μm] due to pressure difference of the tip seal member 17*b* on the orbiting scroll 2 side.

FIG. 5 shows a state where the tip seal member 17*b* on the orbiting scroll 2 side floats up owing to pressure difference and is pressed against the fixed scroll 1. As shown in the enlarged view on the right side of FIG. 5, when the tip seal member 17*b* on the orbiting scroll 2 side passes over the injection port 16, the tip seal member 17*b* is deformed so as to bent into the injection port 16 owing to pressure difference.

From the graph of FIG. 6, it can be seen that the greater the injection port diameter $\phi$inj, or the smaller the tip seal width (the width of tip seal member in a direction perpendicular to the spiral direction), the greater the amount of deflection $\delta$. From the actual machine test results, it is confirmed that the upper limit of $\phi$inj/TIP at which the tip seal member 17*b* does not break and reliability can be ensured is ($\phi$inj/TIP)≤0.95. Therefore, by designing such that the relationship between the injection port diameter $\phi$inj and the tip seal width TIP satisfies $\phi$inj≤(0.95×TIP), the breakage of the tip seal member 17*b* can be prevented.

Figure 7:
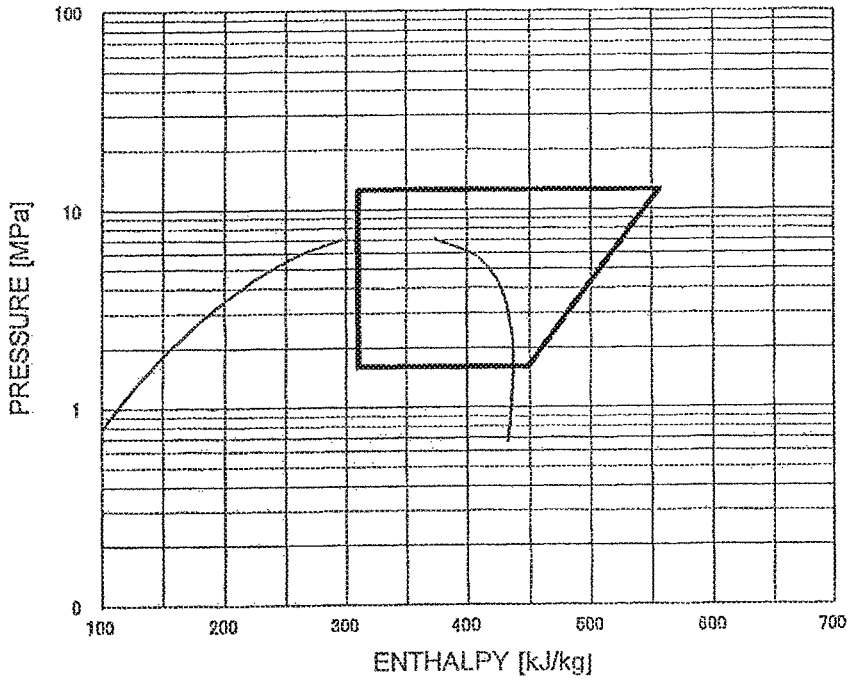
FIG. 7 is a P-h diagram (diagram showing the relationship between pressure [Mpa] and enthalpy [kJ/kg] of refrigerant) when carbon dioxide is used as refrigerant in a refrigeration cycle apparatus having the scroll compressor according to Embodiment 1 of the present invention.

FIG. 7 is a P-h diagram (diagram showing the relationship between pressure [Mpa] and enthalpy [kJ/kg] of refrigerant) when carbon dioxide is used as refrigerant in a refrigeration cycle apparatus having the scroll compressor according to Embodiment 1 of the present invention. Since the critical point of carbon dioxide is as high as 31 degrees C., and the critical pressure of carbon dioxide is as high as about 7.5 MPa, this cycle is a transcritical cycle in which pressure is very high, refrigerant is in a supercritical state on the high-pressure side, and condensation phenomenon does not occur.

Figure 8:
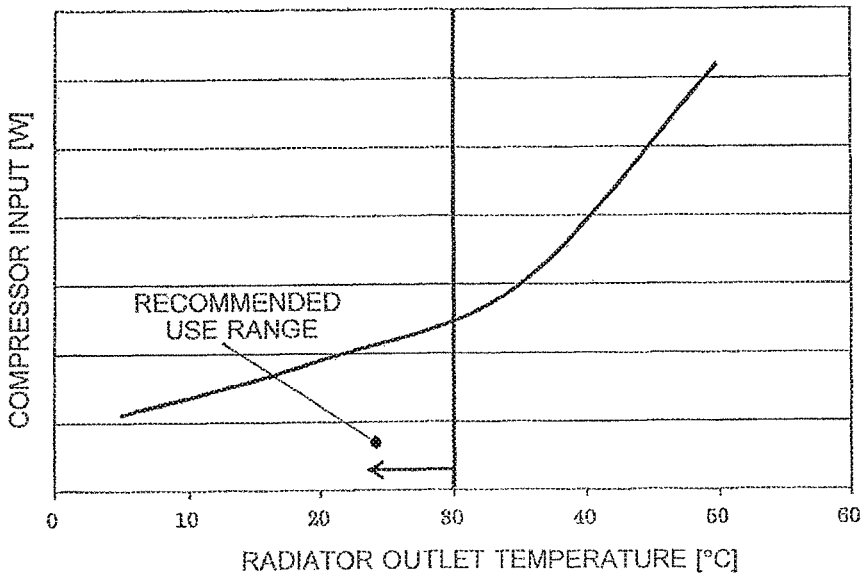
FIG. 8 is a diagram showing the results of measuring the compressor input in a refrigeration cycle apparatus having the scroll compressor according to Embodiment 1 of the present invention using the refrigerant temperature at the refrigerant outlet of the radiator as a parameter.

FIG. 8 is a diagram showing the results of measuring the compressor input in a refrigeration cycle apparatus having the scroll compressor according to Embodiment 1 of the present invention using the refrigerant temperature at the refrigerant outlet of the radiator as a parameter. In FIG. 8, the horizontal axis shows the refrigerant temperature at the refrigerant outlet of the radiator (radiator outlet temperature) [degrees C.], and the vertical axis shows the compressor input [W].

From FIG. 8, it can be seen that the compressor input increases when the radiator outlet temperature exceeds 30 degrees C. The reason for this will be described in comparison with a case where conventional HFC refrigerant is used as refrigerant.

In a scroll compressor using conventional HFC refrigerant, liquid refrigerant is injected using an intermediate injection mechanism, and gas refrigerant in the compression chambers 9 is cooled utilizing latent heat when the liquid refrigerant undergoes the phase transition from the liquid phase to the gas phase. Conventionally, since latent heat is utilized, efficient cooling of gas refrigerant is possible.

However, since supercritical refrigerant such as carbon dioxide does not undergo phase transition, heat of fusion and latent heat do not exist. As shown in FIG. 8, in the radiator 51, carbon dioxide exceeds critical pressure, that is, radiator outlet temperature exceeds 30 degrees C., and carbon dioxide is in a supercritical state. Therefore, when carbon dioxide at a temperature exceeding 30 degrees C. is injected as it is into the scroll compressor 100, in the compression chambers 9, heat is exchanged between refrigerants in a supercritical state that differ in temperature difference, and heat-exchange efficiency is low. Therefore, to lower the temperature of discharge gas discharged from the compressor to the target discharge temperature, intermediate injection flow rate needs to be increased. This seems to be the reason for the increase in compressor input.

Therefore, in a refrigeration cycle apparatus that performs intermediate injection using carbon dioxide, it is desirable to control the radiator outlet temperature to 30 degrees C. or lower, by for example, controlling the opening degree of the expansion valve 52. By controlling the outlet temperature of the radiator 51 to 30 degrees C. or lower, outlet refrigerant of the radiator 51, that is, refrigerant used for injection can be made liquid refrigerant, and gas refrigerant in the compression chambers 9 can be efficiently cooled. The lower limit of the radiator outlet temperature varies depending on the heat medium that cools refrigerant in the radiator 51. When the heat medium is air, the lower limit of the radiator outlet temperature is outside air (ambient) temperature. When the heat medium is water, the lower limit of the radiator outlet temperature is higher than 0 degrees C.

Figure 9:
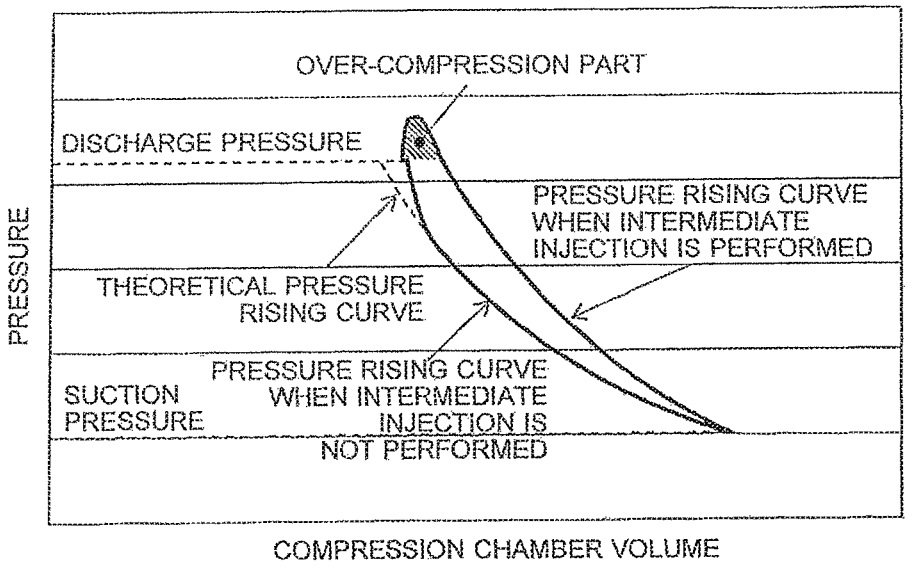
FIG. 9 is a diagram showing pressure rising curves in compression chambers of the scroll compressor according to Embodiment 1 of the present invention.

FIG. 9 is a diagram showing pressure rising curves in compression chambers of the scroll compressor according to Embodiment 1 of the present invention. The horizontal axis shows compression chamber volume, and the vertical axis shows pressure. FIG. 9 shows a pressure rising curve when intermediate injection is not performed, and a pressure rising curve when intermediate injection is performed.

As described above, when discharge temperature is high, intermediate injection is performed to lower discharge temperature. Since, in intermediate injection, intermediate pressure refrigerant is caused to flow into the compression chambers 9, the pressure rising curve when intermediate injection is performed bulges to the upper right in the figure compared to the pressure rising curve when intermediate injection is not performed. When the pressure of injection refrigerant (intermediate pressure) is higher than necessary, an excessive compression part in which the pressure in the compression chambers 9 is higher than the target discharge pressure is generated, and loss is caused. When this loss is caused, the input of the compressor increases, and COP decreases. Therefore, excessive compression is desired to be prevented. In Embodiment 1, excessive compression can be prevented by a configuration in which the injection ports 16 communicate with the discharge port 1*a* as described with reference to FIG. 4 (*f*).

That is, because of a configuration in which the injection ports 16 communicate with the discharge port 1*a*, when an excessive amount of intermediate pressure refrigerant flows in through the injection ports 16, and the pressure in the compression chambers 9 becomes the discharge pressure or higher, refrigerant in the compression chambers 9 is discharged through the discharge port 1*a* to the refrigerant circuit. Therefore, when performing intermediate injection, generation of an excessive compression part can be prevented, and an increase in input of the compressor can be prevented.

As described above, according to Embodiment 1, since the injection port diameter $\phi inj$ and the tip seal width TIP have the relationship of $\phi inj \leq (0.95 \times TIP)$, the breakage of the tip seal member 17*b* can be prevented, and the reliability of the scroll compressor 100 can be ensured.

Since, in the compression process, the injection ports 16 communicate with the discharge port 1*a* provided in the center of the fixed scroll 1, excessive compression can be prevented.

Since each of the compression chambers 9 symmetrical with respect to the discharge port 1*a* is provided with one or more and the same number of injection ports 16, the pressures in the compression chambers 9 are equal. Therefore, the revolution moment acting on the orbiting scroll 2 is minimum, and the advantageous effect of improving the reliability of the Oldham ring preventing rotation can be obtained.

Embodiment 2

The scroll compressor 100 of the above-described Embodiment 1 is a scroll compressor of the so-called high-pressure shell type in which the pressure in the internal space of the shell 8 is high. In contrast, Embodiment 2 is a scroll compressor of the so-called low-pressure shell type in which the pressure in the internal space of the shell 8 is low. The advantageous effect of the scroll compressor of the low-pressure shell type is similar to that of the scroll compressor of the high-pressure shell type. The configuration characteristic of the case of the low-pressure shell type will be described below.

Figure 10:
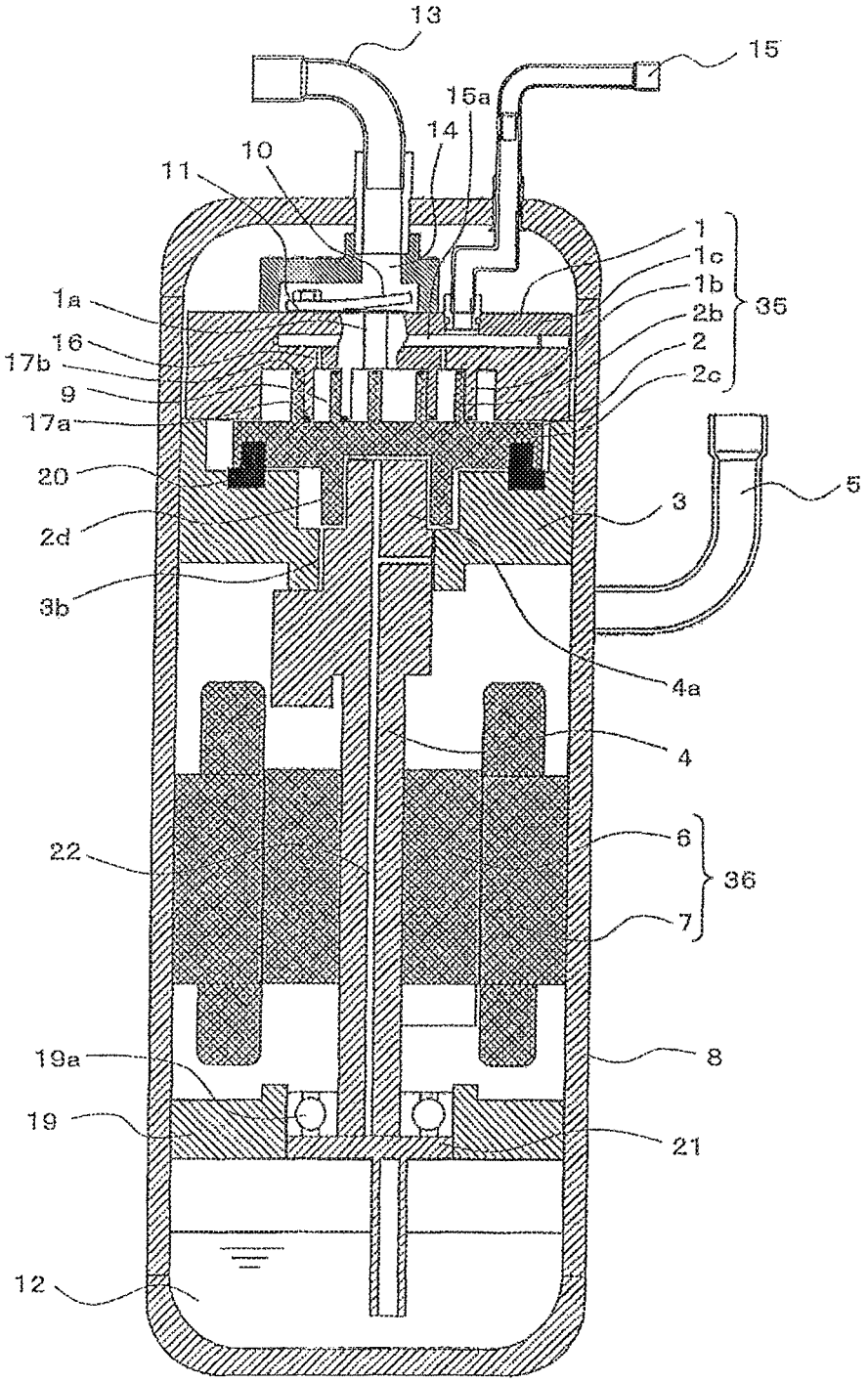
FIG. 10 is a schematic sectional view of a scroll compressor according to Embodiment 2 of the present invention.

FIG. 10 is a schematic sectional view of a scroll compressor according to Embodiment 2 of the present invention. Differences between Embodiment 2 and Embodiment 1 will be mainly described.

In the scroll compressor 100 of Embodiment 2, refrigerant gas discharged through the discharge port 1*a* is guided directly to the discharge pipe 13 without being supplied to the internal space of the shell 8. Therefore, the internal space of the shell 8 is at low pressure owing to suction pressure refrigerant flowing in through the suction pipe 5.

When only suction pressure refrigerant acts on the shell 8, the shell 8 is cooled by outside air (winter) or suction pressure refrigerant (summer) and heat-shrinks. On the other hand, when, during the operation of the compressor, the pressure in the compression chambers 9 becomes higher than the pressure in the injection pipe 15, high-pressure refrigerant flows back to the injection pipe 15 from the compression chambers 9, and therefore the injection pipe 15 is heated by this back-flowing high-pressure refrigerant and is thermally expanded. In this case, the injection pipe 15 is strained in the shell 8, and may break. So, in FIG. 10, part of the injection pipe 15 that is located inside the shell 8 has a structure in which it is bent twice in the axial direction of the injection pipe 15 and a direction perpendicular thereto. By providing the injection pipe 15 with a flexible structure that suppresses elongation due to thermal expansion, the breakage of the injection pipe 15 can be prevented. The number of times that the injection pipe 15 is bent is not limited to twice. A similar advantageous effect can be obtained as long as the injection pipe 15 is bent one or more times. As a specific structure in the case where the injection pipe 15 is bent once, for example, a structure is preferable in which the injection pipe 15 has an L-shaped structure, a protrusion is provided on the back surface of the fixed scroll 1 (the upper surface of the fixed scroll 1 in FIG. 10), and an end of the injection pipe 15 that is located inside the shell 8 is inserted into it.

The invention claimed is:

1. A scroll compressor comprising:

a shell;

a fixed scroll and an orbiting scroll disposed in the shell;

scroll wraps provided respectively in the fixed scroll and the orbiting scroll, the scroll wraps being engaged with each other to form a plurality of compression chambers;

a crankshaft configured to cause the orbiting scroll to perform eccentric revolving motion;

a tip seal member inserted in a tip of each of the scroll wraps of the orbiting scroll along a spiral direction and being in sliding contact with a baseplate of the fixed scroll; and injection ports provided through the baseplate of the fixed scroll and configured to introduce refrigerant having an intermediate pressure between suction pressure and discharge pressure into the compression chambers from an outside of the shell, wherein the refrigerant is composed only of carbon dioxide or is a mixed refrigerant containing carbon dioxide, and each of the injection ports has a diameter $\phi inj$ and the tip seal member has a width TIP in a direction perpendicular to the spiral direction, the diameter $\phi inj$ and the width TIP having a relationship of $\phi inj \leq 0.95 \times TIP$.

2. The scroll compressor of claim 1, wherein the injection ports are configured to, in a compression process, communicate with a discharge port provided in a center of the fixed scroll.

3. The scroll compressor of claim 1, wherein the scroll compressor is of a low-pressure shell type.

4. The scroll compressor of claim 3, further comprising an injection pipe connected to the injection ports and configured to guide the refrigerant from the outside to the injection ports, wherein a part of the injection pipe located in the shell is bent one or more times in an axial direction of the crankshaft and a direction perpendicular to the axial direction.

5. The scroll compressor of claim 1, wherein the plurality of compression chambers have a pair of compression chambers symmetrical with respect to a center of the scroll wraps, and each of the pair of compression chambers is provided with one or more injection ports, and a number of the injection ports is same between the pair of compression chambers.

6. The scroll compressor of claim 5, wherein an outflow side of an injection distribution channel connected to the injection ports and configured to guide the refrigerant from the outside of the shell to the injection ports branches in two directions to communicate with each of the one or more injection ports.

7. A refrigeration cycle apparatus comprising:

a main circuit having the scroll compressor according to claim 1, a radiator, a decompression device, and an evaporator connected in order with pipes, in which refrigerant circulates therethrough;

an intermediate injection circuit branching from between the radiator and the decompression device and being connected to the injection ports; and a flow control valve configured to control a flow rate of the refrigerant in the intermediate injection circuit, wherein the refrigerant in a liquid state is guided from the intermediate injection circuit to the injection ports.

8. The refrigeration cycle apparatus of claim 7, wherein a refrigerant temperature at a refrigerant outlet of the radiator is controlled to 30 degrees C. or lower but higher than 0 degrees C.

* * * * *